United States Patent [19]

Eddy

[11] 4,137,659

[45] Feb. 6, 1979

[54] PERPETUAL CALENDAR

[76] Inventor: Michael A. Eddy, 810 Beech Ct., Plymouth, Mich. 48170

[21] Appl. No.: 706,576

[22] Filed: Jul. 19, 1976

[51] Int. Cl.[2] ..... G09D 3/00

[52] U.S. Cl. ..... 40/107

[58] Field of Search ..... 40/109, 107, 110, 120, 40/122; 283/2

[56] References Cited

U.S. PATENT DOCUMENTS

| | | | |
|---|---|---|---|
| 301,553 | 7/1884 | Bereman | 40/109 |
| 1,109,814 | 9/1914 | Bailey | 40/107 |
| 2,291,703 | 8/1942 | Fifield et al. | 40/107 |

FOREIGN PATENT DOCUMENTS

| | | | |
|---|---|---|---|
| 346712 | 7/1960 | Switzerland | 40/109 |
| 381353 | 10/1932 | United Kingdom | 40/109 |

*Primary Examiner*—John F. Pitrelli

*Attorney, Agent, or Firm*—Eugene F. Malin; Barry L. Haley

[57] ABSTRACT

A perpetual monthly calendar for showing the numerical days of any month related to the proper days of the week comprising a rigid planar surface having a plurality of pegs spaced apart in a horizontal line disposed near the upper edge of the surface and a plurality of vertically positionable rigid strips bearing columnized numerical indicia indicative of particular numerical days, each strip removeably coupled to a different peg. Displayed on the planar surface adjacent each peg are indicia correlating a particular peg to a particular day of the week. The numerical indicia on each strip is displayed in column form, displaying the appropriate numbered sequence one week apart. Each strip has a pair of vertically disposed apertures (except the strip having the first day of the month, which has a single aperture), each of which may receive a peg to mount the strips vertically on the board. A particular monthly numeral-day array is achieved by positioning the strips relative to the pegs.

1 Claim, 5 Drawing Figures

PERPETUAL CALENDAR

BACKGROUND OF THE INVENTION

This invention relates generally to a perpetual calendar, and more specifically to a monthly calendar which can be utilized to display numerical values for all days for any month of any year.

For any given particular calendar month, as is known, the first day of the month does not always fall on a particular given day of the week. Also the number of days in a particular month varies. Many perpetual calendars are shown in the prior art which provide variable indicia for relating numbered calendar days. The devices shown in the prior art are complicated, expensive, unwieldly and not aesthetically pleasing.

The instant invention provides a perpetual calendar that can be easily changed to accommodate the proper numerical calendar days for any month, that is aesthetically pleasing and that is constructed utilizing a reduced number of parts.

Brief Description of the Invention

A perpetual, monthly calendar which may be utilized to display the numerical values of days for any particular month comprising a rigid, planar surface having a plurality of strip connecting means, such as pegs, spaced apart in a horizontal row near the upper edge of the planar surface. A plurality of elongated, narrow strips are connected to the pegs using apertures in the strips, each strip having two vertically adjacent apertures, except the strip with the first day of the month which has one aperture. The strips may be transparent to allow the information and indicia displayed on the board to be visible regardless of which aperture is utilized on the strip to vertically adjust the particular column day numbers. Disposed on each strip is a numbered indicia column representing numerical dates in one month of a particular day of the week. Indicia of a particular day of the week are displayed near each peg, such that each peg represents a different day of the week.

Additional opaque cards may be affixed to certain strips to cover numerals "29," "30" and "31" for months not having these particular days.

It is an object of this invention to provide a perpetual, monthly calendar that is extremely efficient to utilize and yet aesthetically pleasing.

It is another object of this invention to provide a perpetual calendar which utilizes elongated strips displaying the numerical value of the particular days of a month which may be selectably registered relative to a particular day of the week, displayed in columns by vertical movement of the strips.

In accordance with these and other objects which will be apparent hereinafter, the instant invention will now be described with particular reference to the accompanying drawings.

PREFERRED EMBODIMENT OF THE INVENTION

Figure 1:
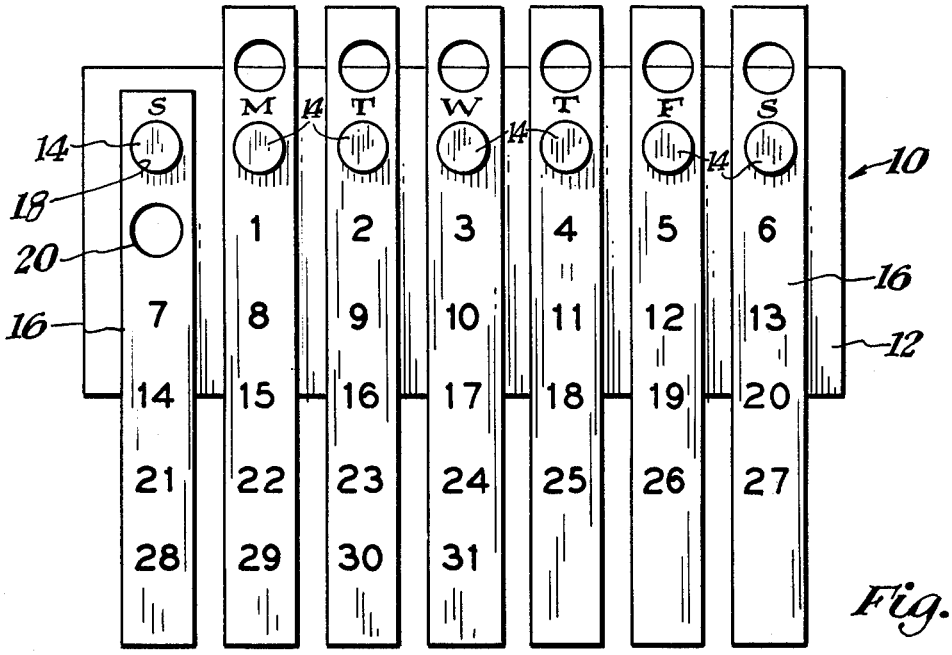
FIG. 1 shows a front elevational view of the instant invention.

Referring now to the drawings and, specifically FIG. 1, the instant invention is shown generally at 10 comprised of a rigid, rectangular, planar surface 12 having a plurality of pegs 14 affixed near the upper top edge of the planar surface 12. Displayed on surface 12 above each peg is indicia representative of different days of the week. As shown, a single letter represents a particular day of the week. Attached removeably to each peg 14 is an elongated, narrow, strip 16, with each strip 16 having different numerical indicia representative of particular calendar dates. Each strip 16 has a pair of apertures vertically disposed with respect to each other adjacent one end of the strip, the apertures being 18 and 20. The apertures of the strip 16 are sized to fit over the pegs 14. The purpose of having two apertures in each strip is to allow for alternate positions of each strip with respect to the peg so that the proper numerical values can be related to the days of any given month, properly arranged by the vertical positioning of each strip relative to the other remaining strips. Each strip is transparent so that the indicia disposed on the planar surface 12 showing the particular day of the week is not blocked from view but is readily optically visible, even though the strips themselves are vertically adjusted upwardly from the pegs 14.

Figure 2A:
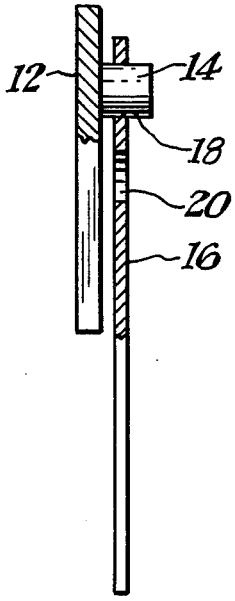
FIG. 2*a* shows a side elevational view of the instant invention with a strip disposed in a first position.
Figure 2B:
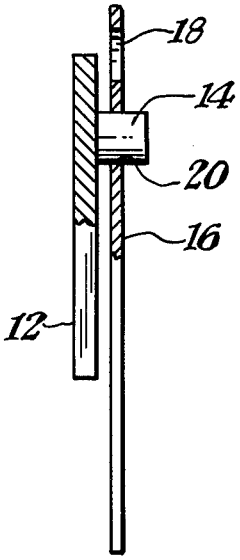
FIG. 2*b* shows a side elevational view of the instant invention with the closest strip in a second position.

FIGS. 2*a* and 2*b* show a particular strip 16 which is disposed and attached to peg 14 through either aperture 18 shown in FIG. 2*a* or aperture 20 shown in FIG. 2*b*, the apertures 18 and 20 providing for vertical registration of a particular rigid transparent strip containing indicia of the numbered day of the particular month.

Each of the daily strips 16 shown in FIG. 1 can be vertically adjusted such that for any given month in any year the proper numerical daily calendar dates can be achieved merely by adjustment of each individual strip until the number are coordinated with the days of the week. Strips may also be mounted on different pegs so that the proper numbers agree with the particular days of the week.

Figure 3:
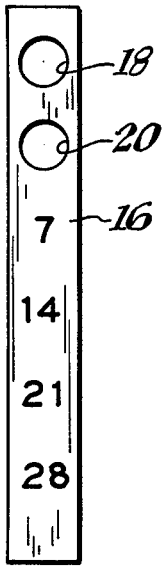
FIG. 3 shows a front elevational view of a single strip.

FIG. 3 shows a particular strip having numerical indicia displayed which are one week apart such as the numbers "7," "14," "21," and "28." Transparent strip 16 includes apertures 18 and 20 disposed near one end through which the pegs 14 shown above. The apertures could be disposed anywhere on a strip, dependent upon the particular planar surface display. Although shown as transparent, the display planar surface 12 could also be enlarged with the daily indicia disposed far enough above either position on the strip so that the strips could be translucent or opaque.

Figure 4:
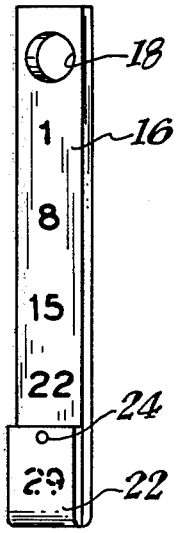
FIG. 4 shows a front elevational view of a strip with an opaque card attached thereto.

FIG. 4 shows a strip 16 having a single aperture 18, the strip having indicia showing the first day of the week. Since the first day will always appear in the top row, only one aperture is needed. Also attached is an opaque card 22 connected to strip 16 by peg 24 which hides numeral "29" from view, which may be necessary when displaying the month of February. Additional cards can be utilized and affixed to respective strips to hide the "30th" and "31th" days when necessary.

The device may be wall mounted or disposed in any convenient position for a particular calendar.

The pegs themselves may be attached to the planar surface in conventional manner and may be of a conventional well known material as is the planar surface board itself.

The strips may be attached to the board surface by other means than pegs such as by hooks, magnets, clips or the like.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A perpetual calendar comprising:

a rigid planar strip mounting surface, said mounting surface having indicia disposed thereon representing each day of a week on a calendar;

a plurality of mounting pegs, each peg connected to said mounting surface, with a singular peg being disposed in close proximity to a particular indicia representative of a single day of the week;

a plurality of transparent elongated strips, each of said strips having numerical indicia disposed thereon, said numerical indicia on each strip representative of particular days of a month on a calendar, each strip having numerical indicia disposed in column array with the numerals disposed in value having values representative of a single day of the week for an entire month;

each of said strips having a pair of apertures disposed along the longitudinal axis of said strip, each of said apertures being engageable with a connecting peg for mounting each strip on a mounting peg, said strip covering said indicia on said mounting surface;

each of the numerals disposed on a single transparent strip being numerically spaced one week apart on a calendar whereby each transparent strip is individually vertically disposable relative to said mounting surface to provide an array displaying a perpetual calendar in which the days of the month may be correctly displayed for any particular month of the calendar;

connecting means coupled to the transparent strips in proximal relationship to numerical indicia displaying the 29th, 30th, and 31st days of the month; and a plurality of opaque covers, each being engageable to said connecting means for covering respectively the 29th, 30th and 31st days.

* * * * *